US007708154B2

(12) United States Patent
Lang et al.

(10) Patent No.: US 7,708,154 B2
(45) Date of Patent: May 4, 2010

(54) DISPENSING SYSTEM

(75) Inventors: Thomas Lang, New Milford, CT (US); Chris Crandall, New Milford, CT (US); Hidenobu Hara, Danbury, CT (US); Pavan Raja, Danbury, CT (US)

(73) Assignee: Rock-Tenn Shared Services, LLC, Norcross, GA (US)

( * ) Notice: Subject to any disclaimer, the term of this patent is extended or adjusted under 35 U.S.C. 154(b) by 541 days.

(21) Appl. No.: 11/444,939

(22) Filed: May 31, 2006

(65) Prior Publication Data

US 2007/0278164 A1 Dec. 6, 2007

(51) Int. Cl.
*A47F 1/04* (2006.01)

(52) U.S. Cl. ..... 211/59.3

(58) Field of Classification Search ..... 211/71.01, 211/72, 73, 49.1, 50, 51, 59.3, 59.2; 221/279, 221/56, 58, 59; 206/758, 765, 556, 817; 220/559

See application file for complete search history.

(56) References Cited

U.S. PATENT DOCUMENTS

| | | | |
|---|---|---|---|
| 691,990 | A | 1/1902 | Warren |
| 1,034,318 | A | 7/1912 | Sobretto et al. |
| 1,123,071 | A | 12/1914 | Bell |
| 1,319,084 | A | 10/1919 | Hume |
| 1,533,147 | A | 4/1925 | Svendsgaard |
| 1,592,720 | A | 7/1926 | Butler |
| 1,614,363 | A | 1/1927 | Hicks |
| 1,680,275 | A | 8/1928 | Albaugh |
| 1,755,655 | A | 4/1930 | Langenfeld |
| 1,813,935 | A | 7/1931 | Knee |
| 1,913,843 | A | 6/1933 | Marcuse |
| 2,142,053 | A | 12/1938 | Hoban |
| 2,163,280 | A | 6/1939 | Hibshman |
| 2,304,533 | A | 12/1942 | Bright |
| 2,824,666 | A | 2/1958 | Hausladen |
| 2,977,023 | A | 3/1961 | Meyer |
| 3,161,295 | A | 12/1964 | Chesley |
| 3,199,724 | A | 8/1965 | Domenico et al. |
| 3,313,448 | A | 4/1967 | Howard et al. |
| 3,351,233 | A | 11/1967 | Chanoch et al. |
| 3,452,899 | A | 7/1969 | Libberton |
| 3,578,207 | A | 5/1971 | Danow |
| 3,583,568 | A | 6/1971 | Crossien |
| 3,805,962 | A | 4/1974 | Bendiksen |
| 3,923,159 | A | 12/1975 | Taylor et al. |
| 3,957,173 | A | 5/1976 | Roudebush |
| 3,968,900 | A | 7/1976 | Stambuk |
| 4,007,853 | A | 2/1977 | Bahneman |
| 4,190,179 | A | 2/1980 | Moss et al. |
| 4,275,819 | A | 6/1981 | Perez |
| 4,308,974 | A | 1/1982 | Jones |
| 4,336,892 | A | 6/1982 | Cox et al. |

(Continued)

*Primary Examiner*—Jennifer E. Novosad
(74) *Attorney, Agent, or Firm*—Kilpatrick Stockton LLP

(57) ABSTRACT

Embodiments of the present invention provide a dispensing system (for dispensing a product) that helps prevent theft, while also providing a simple, easy to manufacture advancing or pushing system that advances product forward. In certain embodiments, the system comprises a base having a back portion, a platform having a track, a flexible plastic pushing device with a connecting end and a pushing end, wherein the connecting end is attached to the back portion of the base, and wherein the pushing end slides along the platform track to advance product to be dispensed forward, and a hood that covers the base.

15 Claims, 6 Drawing Sheets

U.S. PATENT DOCUMENTS 4,474,300 A 10/1984 Entis
4,600,110 A * 7/1986 Timor ..... 211/120
4,679,684 A 7/1987 Glaser
4,682,826 A 7/1987 Mestdagh
4,887,737 A 12/1989 Adenau
4,962,867 A 10/1990 Ficken et al.
5,067,634 A 11/1991 Guindulain Vidondo
5,096,367 A 3/1992 Winski
5,111,942 A 5/1992 Bernardin
5,121,854 A 6/1992 Trouteaud et al.
5,150,101 A 9/1992 Goris et al.
5,161,702 A * 11/1992 Skalski ..... 211/59.3
5,199,598 A 4/1993 Sampson
5,229,749 A 7/1993 Yenglin
5,252,948 A 10/1993 Goris et al.
5,263,596 A 11/1993 Williams
5,335,816 A 8/1994 Kaufman et al.
5,375,735 A 12/1994 Huvey et al.
5,375,737 A 12/1994 Ficken
5,400,919 A 3/1995 Gomm et al.
5,462,198 A 10/1995 Schwimmer
5,641,077 A * 6/1997 Tufano et al. ..... 211/54.1
5,665,304 A 9/1997 Heinen et al.
5,813,568 A 9/1998 Lowing
5,906,283 A * 5/1999 Kump et al. ..... 211/54.1
5,988,407 A * 11/1999 Battaglia ..... 211/51
6,015,051 A * 1/2000 Battaglia ..... 211/59.3
6,082,558 A * 7/2000 Battaglia ..... 211/59.3
6,176,558 B1 1/2001 Hlade et al.
6,206,237 B1 3/2001 Dillon et al.
6,263,259 B1 7/2001 Bartur
6,318,591 B1 11/2001 Martin
6,325,242 B1 12/2001 Izawa et al.
6,409,028 B2 * 6/2002 Nickerson ..... 211/59.3
6,474,478 B1 11/2002 Huchner et al.
6,478,187 B2 11/2002 Simson et al.
6,520,604 B1 2/2003 Yasaka et al.
6,604,652 B1 8/2003 Trautwein
6,655,536 B2 * 12/2003 Jo et al. ..... 211/59.3
6,659,291 B2 12/2003 Huchner et al.
6,666,533 B1 * 12/2003 Stavros ..... 312/348.3
6,691,891 B2 2/2004 Maldonado
D491,403 S 6/2004 Gervasi
6,749,071 B2 * 6/2004 Caterinacci ..... 211/40
6,851,572 B2 * 2/2005 Simpson ..... 221/47
7,149,600 B2 12/2006 Rippolone
7,293,663 B2 * 11/2007 Lavery, Jr. ..... 211/59.3
2003/0029816 A1 2/2003 Huchner et al.
2003/0178435 A1 9/2003 Yamaguchi
2004/0026344 A1 2/2004 Sedon et al.
2004/0059464 A1 3/2004 Veenstra et al.
2004/0060944 A1 4/2004 Gervasi
2004/0084386 A1 5/2004 Huchner et al.
2005/0029205 A1 2/2005 Mansfield et al.
2005/0189369 A1 9/2005 Vlastakis
2005/0224432 A1 * 10/2005 Alonso et al. ..... 211/59.3
2006/0237381 A1 10/2006 Lockwood
2006/0266762 A1 11/2006 Andrews

* cited by examiner

DISPENSING SYSTEM

BACKGROUND OF THE INVENTION

1. Field of the Invention

The invention relates generally to systems for dispensing systems that push the product forward and that also incorporate theft deterrent features.

2. General Background

When items are displayed at retail, as product is removed from the front of the display rack or box for purchase, the remaining product remains at the back. This can make it difficult for a customer to see that there is still product remaining to be purchased if the rack or box is above eye-level (e.g., if a box is placed high on a shelf and the consumer cannot see to the back of the display box). It can also make it difficult for the consumer to reach into the back of the box to remove the remaining product. This can results in lower sales numbers than would otherwise be achieved.

In some instances, manufacturers or retailers will include fillers at the back of product boxes to help the boxes appear full or to help the product stand upright rather than falling back into the box. These temporary solutions are not optimal, in part because fillers take time and cost to manufacture and load.

There are some automatic dispensing systems on the market that feature intricate levers and electronic systems. These systems, however, are expensive to manufacture and can be time consuming to stock. They may also be more prone to malfunction than a simple dispensing system. It is thus necessary to provide a dispensing system that pushes product forward for purchase, but that is also simple and economical to manufacture and stock.

Moreover, theft of small items in retail stores is an all too common problem. Items that are in high demand by thieves include over-the-counter (OTC) products such as analgesics and cough and cold medications, razor blades, camera film, batteries, videos, DVDs, smoking cessation products, and infant formula. Shelf sweeping is a particular problem for small items. It occurs when someone removes all the shelf stock (and in some instances, removes the hook on which the merchandise is hanging), and exits the store, similar to a "smash and grab" shoplifting technique. Shelf sweeping relies on excessive quantities of product being available on the shelf. However, retailers need to keep substantial inventory on shelf or incur the cost of constantly restocking.

Retailers are constantly challenged to balance the needs of legitimate consumers' access to high theft items with measures to minimize the incidence of theft. It has long been known to place items such as cigarettes, sodas, and newspapers in vending machines. Such machines require complete self-service by the customer. The customer places money into the vending machine and the machine dispenses the desired item. However, vending machines may be inconsistent with the way that people currently purchase items; many people prefer to use credit or debit cards instead of cash. People may also wish to simply put products into a cart and pay all at once, rather than interface with multiple vending machines for various purchase. Vending machines may also be inconvenient and occupy a great deal of space, particularly if a separate vending machine is needed for various types of products or for each manufacturer that sells product in a particular location.

Because theft has become so rampant in certain product categories, such as razors, infant formula, and cold medicine, many retail stores are taking the products off the shelves and placing them behind the counter or under lock-and-key. Customers must request the products in order to make a purchase. This requires additional labor costs to provide individual service to customers who would normally not require it. It also makes it difficult for customers to compare products. Furthermore, it may be impossible where the space behind the counter is limited and is needed for prescription medications. In some cases, some products are simply unavailable due to high pilferage rates.

Therefore, a device or dispensing apparatus that minimizes the incidence of product theft, particularly sweeping, is needed. The device or dispensing apparatus should also be able to fit within common grocery, drug store or other retail environment shelves. It is also desirable that the device or dispensing apparatus effectively display and push product forward so that consumers can easily identify the products. It is also preferable that the dispensing apparatus be easy to use.

Thus, there is a need to provide systems that discourage or prevent theft of product, as well as systems that display product in a way that makes an item easy to retrieve from the shelf, without the consumer having to reach back into a tray to retrieve items from the back if all items from the front have been removed.

SUMMARY

Embodiments of the present invention provide a dispensing system (for dispensing a product) that helps prevent theft, while also providing a simple, easy to manufacture advancing system that advances product forward. In certain embodiments, the system comprises a base having a back portion, a platform having a track, a flexible plastic pushing device with a connecting end and a pushing end, wherein the connecting end is attached to the back portion of the base and wherein the pushing end slides along the platform track to advance product to be dispensed forward, and a hood that covers the base. These elements may be formed as separate pieces and attached to one another during assembly (e.g., by tabs and slots or by adhesive) or they may be formed integrally as a one-piece unit. Other features may be provided as described in more detail below.

DETAILED DESCRIPTION OF THE DRAWINGS

Figure 1A:
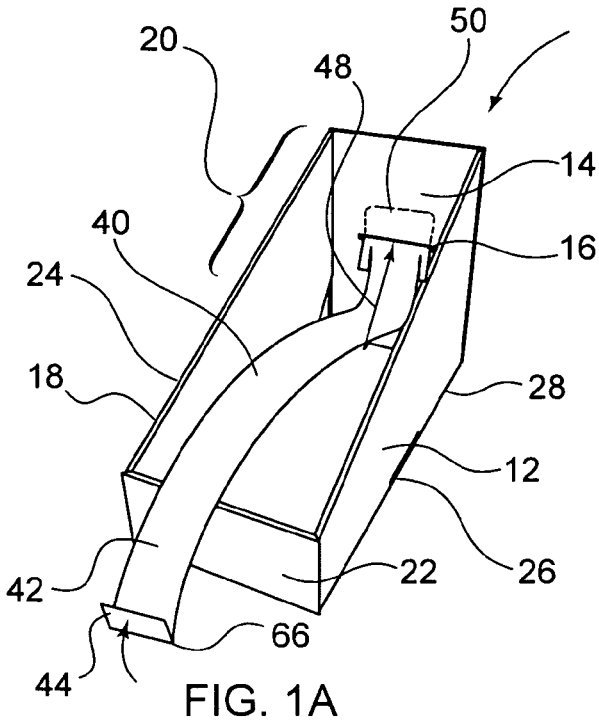
FIGS. 1A and 1B show front perspective views of a partially assembled dispensing system according to certain embodiments of the invention.
Figure 1B:
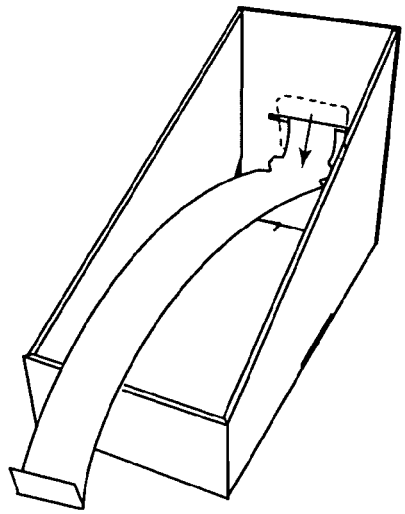

Embodiments of the present invention provide dispensing systems that push product forward as one is removed, are easily refilled for reuse, and that also prevent sweeping the product off the shelf. As shown in FIGS. 1A and 1B, one embodiment of dispensing system 10 has a base 12 and a flexible plastic pushing device 40. Base 12 may be manufactured of corrugated material, paperboards, plastic, or any other appropriate material. (For example, if the dispensing system is to be used to hold and dispense products that are heavier than razor blades, etc., then a heavier type of material may be appropriate.) Pushing device 40 may be manufactured of 30 ml PVC flat die-cut material. This material is particularly preferred because it is flexible but provides a stable "pushing back" action for advancing product when appropriate. It should be understood, however, that other types of plastics or other materials may be used. For example, pushing device may be rubber, polyethylene terephthalate, polypropylene, polyethylene, combinations thereof, or any other appropriate material that has sufficient strength to accomplish the pushing function, but sufficient flexibility to curve as shown and described below. The advantage of using plastic over metal is that plastic is less expensive and easier to use, although of course, it should be understood that various types of materials may be used in connection with the embodiments described herein.

Base 12 has a front display area 22, a back portion 14 with a slot 16, and sides 18 with a downward slope 20 at the upper portion 24 and slots 26 at the lower portion 28. The flexible plastic pushing device 40 has a pushing end 42 with a foot 44 that is formed at fold 46. It also has a connecting end 48 with a forked portion 50. Fork 50 of connecting end 48 is intended to cooperate with slot 16 of base 12. For example, as shown in FIGS. 1A and 1B, forked portion 50 slides through slit 16 so that the flaps 54 at the ends of fork 50 can pass through slit 16, but then be bent back to form a stop that will abut the back of back portion 14 of base 12. This prevents pushing device 40 from being easily pulled out of place.

Figure 2:
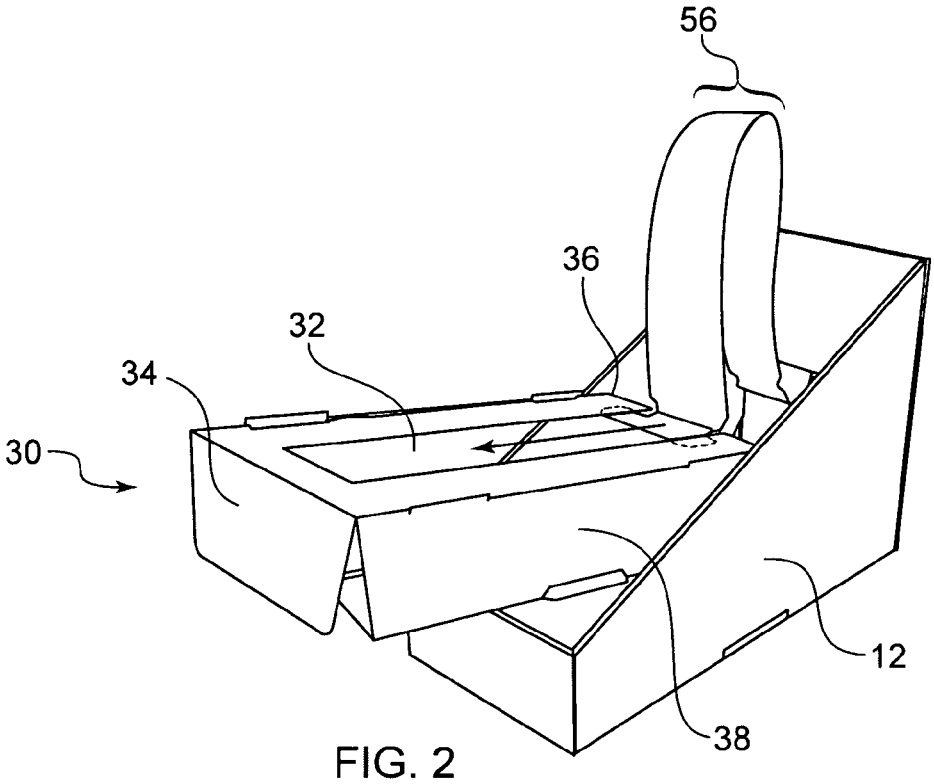
FIG. 2 shows a side perspective view of the system of FIG. 1 with a platform being inserted.
Figure 3A:
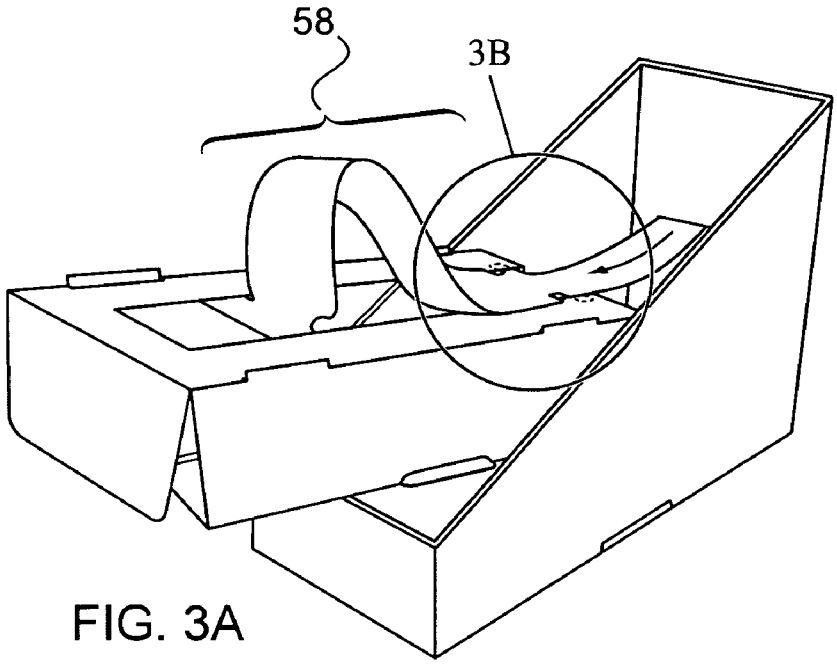
FIGS. 3A and 3B show a side perspective view of the system of FIG. 2 with a pushing device being advanced.

FIG. 2 shows a platform 30 for use with base 12. Although shown as two separate pieces, it should be understood that platform 30 and base 12 may be formed as a one-piece unit. Platform 30 has a track 32 that accommodates pushing device 40. Track 32 may be the entire length of platform 30, although it need not necessarily be so. Platform 30 also has a forward portion 34, a rearward portion 36, and sides 38. In one embodiment, forward portion 34, rearward portion 36, and sides 38 are all folded down to create a square platform that can be more sturdy than simply a flat platform. FIG. 2 shows pushing device 40 in its highly tensioned state 56 (e.g., if the system 10 is full of product to be dispended), and FIG. 3A shows pushing device 50 in one of its advancing positions 58 (e.g., as product is removed from system 10).

The length of the pushing device should be at least partially greater than the length of the base so that appropriate tension can be achieved. It may be useful to think of the motion of pushing device 40 as that of a tsunami wave, and the length should be sufficient to allow the tensioned state and advancing position to be achieved.

Figure 3B:
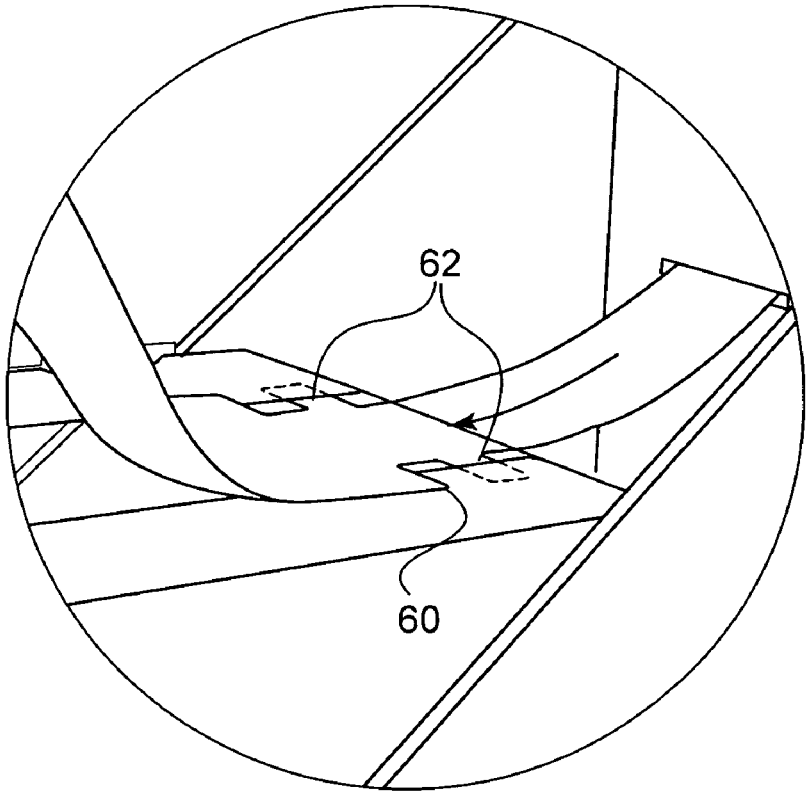

FIG. 3B is a close-up of the notched tab 60 of pushing device 40. Notched tab 60 is an area having slight extension portions 62 that cooperate with track 32. The notched tab extension portions 62 sit under the track 32 to hold the pushing device 40 in place in the back of the dispensing system 10. This helps to maintain the pushing device 40 in spring tension at all times.

Figure 4:
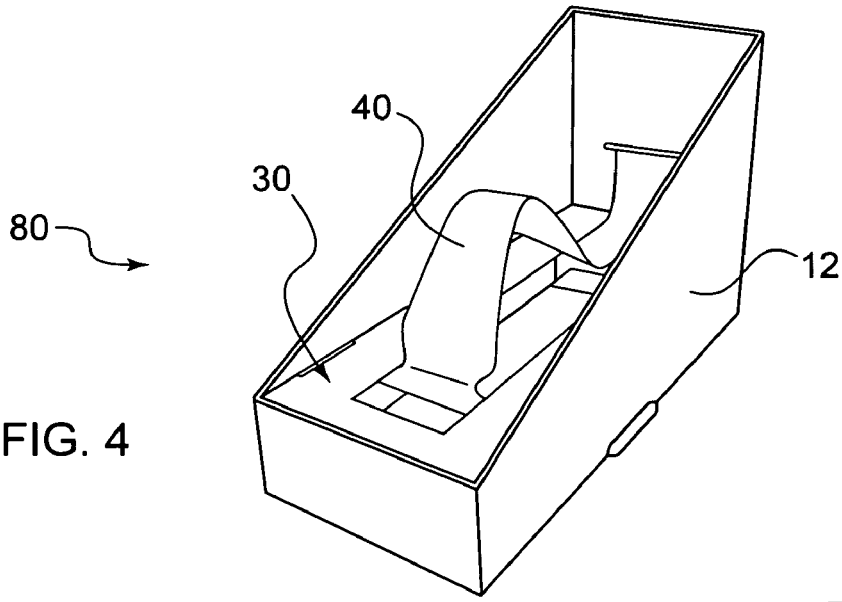
FIG. 4 shows a front perspective view of the partially assembled system of FIG. 3.

FIG. 4 shows the base 12 with platform 30 (which may be referred to as a base/platform assembly 80) assembled together (or, as previously mentioned, the base 12 and platform 30 may be formed as a one-piece unit) and pushing device 40 in place. This configuration can be referred to as a base/platform assembly 80.

Figure 5:
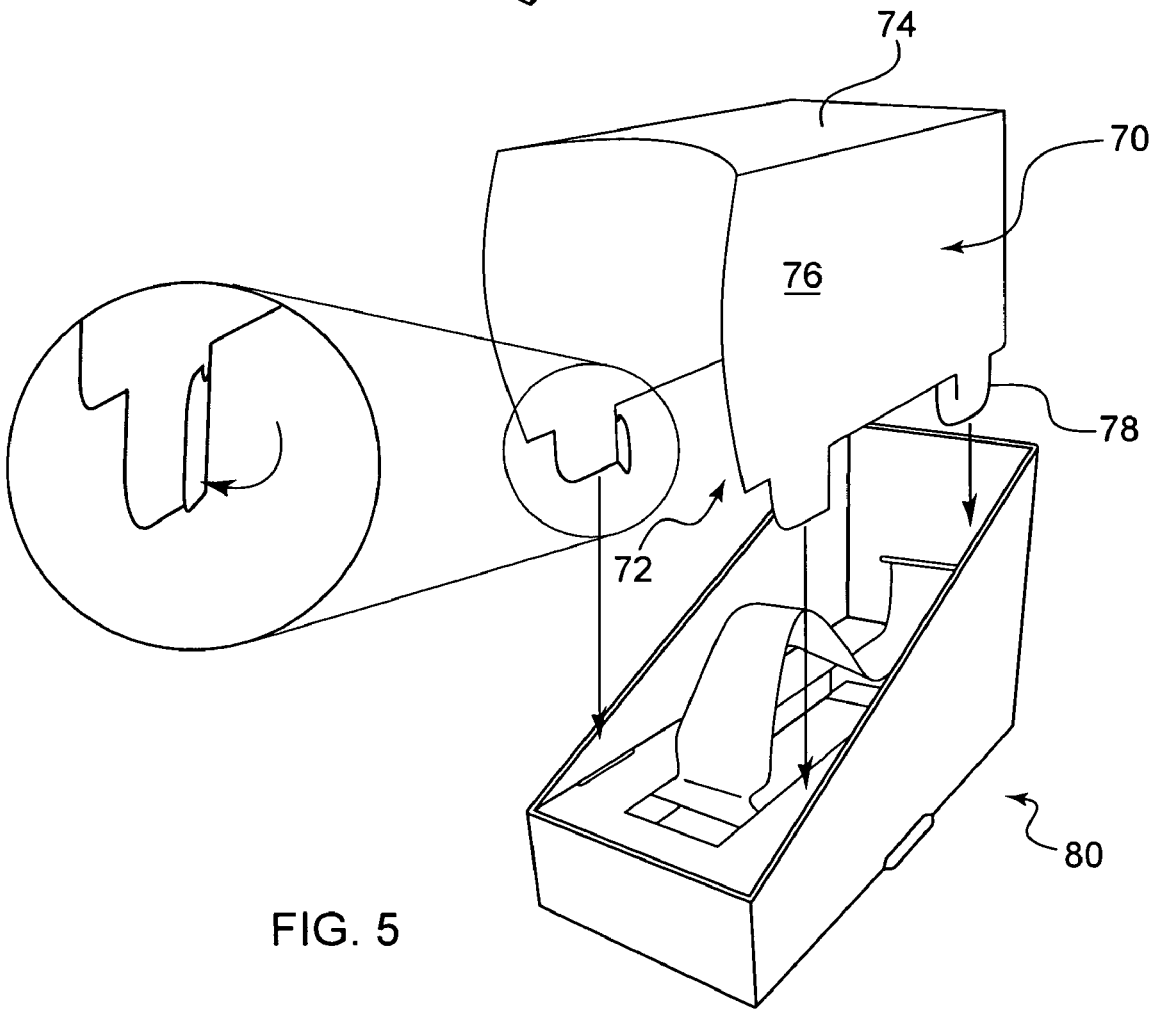
FIG. 5 shows a hood being placed on the system of FIG. 4.
Figure 6:
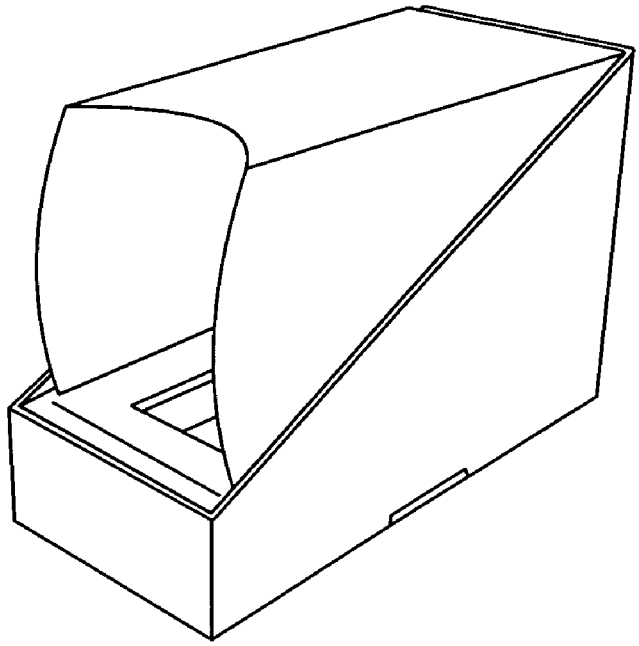
FIG. 6 shows a side perspective view of one embodiment of an assembled dispensing system

Once assembly 80 is configured, a hood 70 is placed over assembly (as shown in FIG. 5) in order to prevent sweeping of the product off of shelves. Hood 70 is preferably configured such that only one or two products may be removed at a time, preventing a potential thief from grabbing handfuls or armfuls of product at once. Hood 70 has a display opening 72, a top 74, and sides 76. It is possible for hood 70 to have a back, but in the embodiment shown, back portion 14 of base 12 is high enough to form the back of system 10. Hood also has tabs 78 at the ends of sides 76 in order to secure hood in place with respect to assembly 80. For example, the slots 26 at the lower portion of base 12 may cooperate with tabs 78 of hood 70. Although not shown, it should be understood that base may have tabs and hood may have slots, as long as there is a connecting mechanism to engage assembly 80 and hood 70. An example of a completed system 10 (without product loaded in place yet) is shown in FIG. 6.

Figure 7:
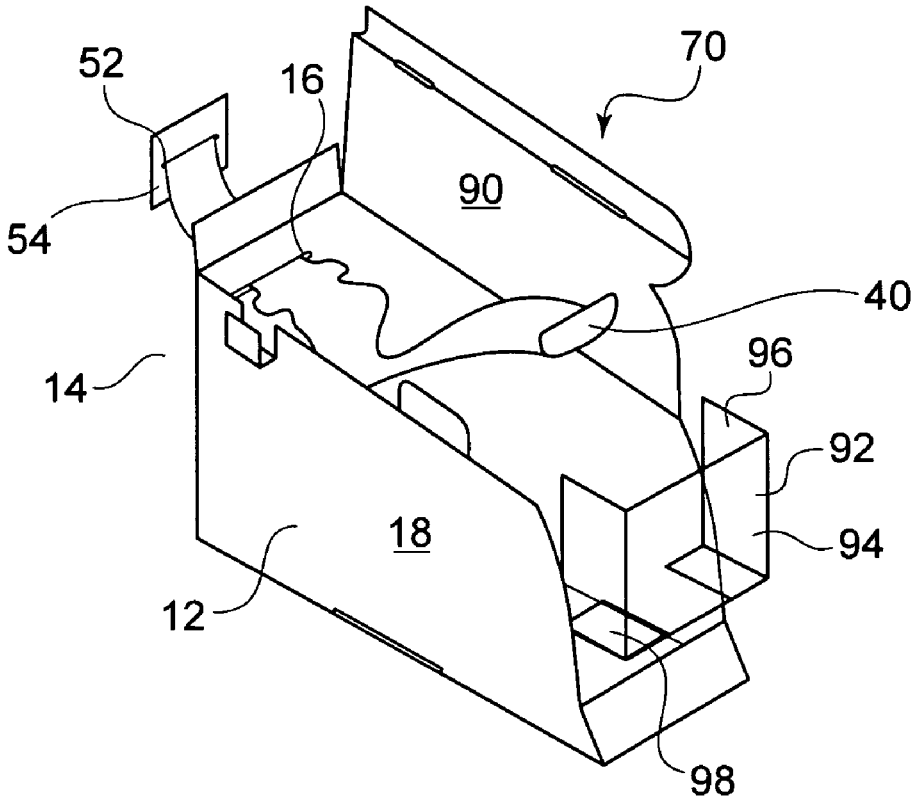
FIGS. 7 and 8 show side perspective views of an alternate embodiment of a partially assembled dispensing system according to certain embodiments of the invention.

An alternate embodiment is shown in FIG. 7. This embodiment shows one example of how base 12 and hood can be formed as a one-piece assembly. In this instance, base 12 has back portion 14 and sides 18, as well as a flap 90 that serves as hood 70. This embodiment also features a guard 92, which can help further the anti-sweeping function of the dispensing system 10. Guard 92 has a face portion 94, side portions 96, and feet portions 98 that secure into place with either an adhesive, by being pressed down by the insertion of platform 30, or by any other appropriate securing technique. As shown in FIG. 7, the pushing device 40 is inserted through slot 16 of base 12, and once forked portion 52 is separated from flaps 54, device 40 is pulled down to lock it into place.

Figure 8:
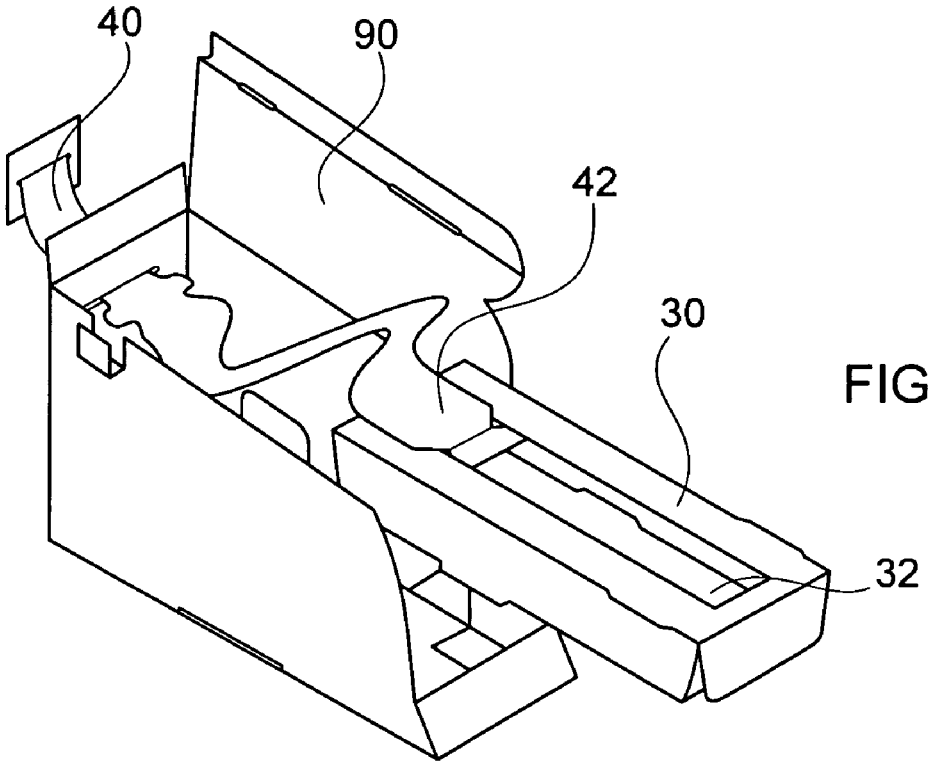
Figure 9:
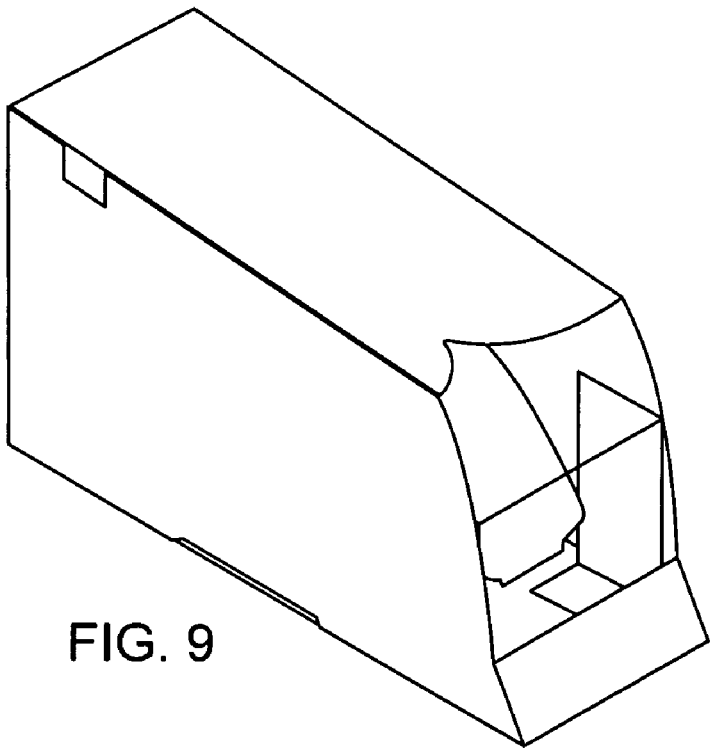
FIG. 9 shows a side perspective view of the system of FIGS. 7 and 8 in an assembled configuration.
Figure 10:
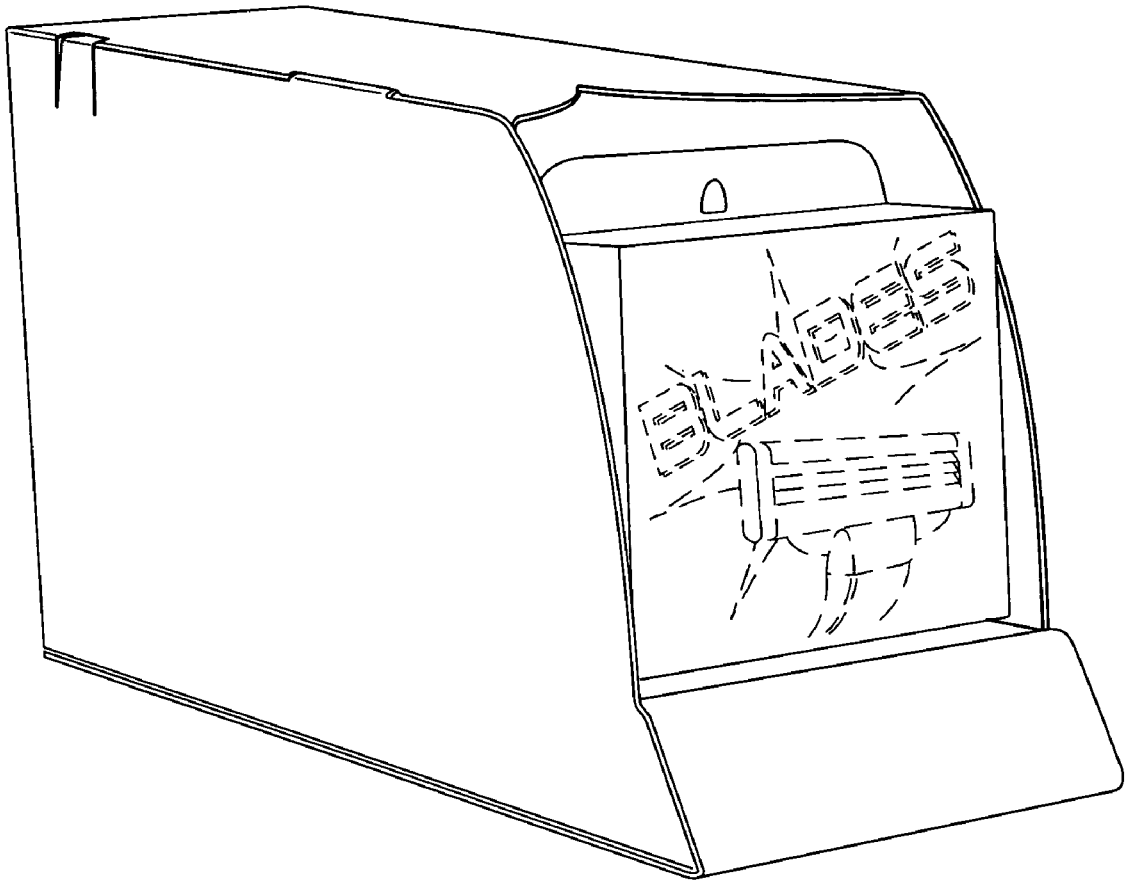
FIG. 10 shows the dispensing system of FIG. 9 loaded with product.

Then, as shown in FIG. 8, the platform 30 (if provided as a separate piece) can be secured into place and the pushing end 42 of device 40 is secured into place in the track 32. Flap 90 is then tucked or otherwise secured into place so that system 10 is assembled as shown in FIG. 9, and ready to be loaded with product, as shown in FIG. 10.

In order to load product, the stocking person may insert product in front of pushing device 40, which will push device 40 back, create tension in the device 40, and allow product to be loaded. When one product is removed, the next product will be pushed forward to the front position. Another advantage is that rather than being a display box only (e.g., a box that is thrown away once all product has been removed or purchased), embodiments of the present invention may be used more than once and restocked easily and conveniently. The hood 70 and/or guard 92 may also prevent a potential thief from sweeping large amounts of product off the shelf.

Changes and modifications, additions and deletions may be made to the structures and methods recited above and shown in the drawings without departing from the scope or spirit of the invention and the following claims.

What is claimed is:

1. A dispensing system for dispensing product, comprising:

(a) a base comprising a back portion and a platform;

(b) the platform comprising a platform portion with a single track opening defined by a central opening cut out of the platform portion;

(c) a single flexible plastic pushing device with a connecting end and a pushing end, wherein the connecting end is removably attached to the back portion of the base, wherein the pushing end comprises a pushing foot with side tabs that are configured to be secured in the track opening underneath the platform portion, such that the pushing foot is secured against and rides within the track opening in use, and wherein the pushing device forms a wave shape that flattens as product is advanced forward.

2. The dispensing system of claim 1, wherein the base has sides that are downwardly sloped.

3. The dispensing system of claim 1, wherein the flexible plastic pushing device has a pushing end foot that is adapted to be engaged in and slide within the central opening in the platform track.

4. The dispensing system of claim 1, wherein the flexible plastic pushing device has a notched tab that is adapted to be engaged in the platform track.

5. The dispensing system of claim 1, wherein the base and the platform form a one-piece configuration.

6. The dispensing system of claim 1, wherein the base and the platform are formed of two separate pieces that are locked together to form a base/platform combination, and wherein the flexible plastic pushing device is locked into the back portion of the base/platform combination.

7. The dispensing system of claim 1, wherein the back portion comprises a slot, and wherein the flexible plastic pushing device has a connecting end that is forked to fit into the slot to secure the pushing device to the back portion.

8. The dispensing system of claim 1, further comprising a guard at the front of the dispensing system.

9. The dispensing system of claim 1, further comprising a hood that covers the base.

10. The dispensing system of claim 9, wherein the base and the hood form a one-piece configuration.

11. The dispensing system of claim 9, wherein the base and the hood are separate elements that are attached via tabs and slots.

12. The dispensing system of claim 1, wherein the platform comprises a forward portion, a rearward portion, and sides, and wherein the forward portion, the rearward portion, and the sides are folded down to create a raised platform.

13. The dispensing system of claim 1, wherein the base comprises corrugated material, paperboard, or plastic.

14. The dispensing system of claim 1, wherein the dispensing system is provided as a single modular unit.

15. The dispensing system of claim 1, wherein the dispensing system is comprised of paperboard and is configured to be assembled by folding.

* * * * *